US005662282A

United States Patent [19]

Meyer

[11] Patent Number: 5,662,282

[45] Date of Patent: Sep. 2, 1997

[54] CENTRIFUGAL MILL WITH EXCHANGEABLE CASSETTE

[75] Inventor: Hans-Jürgen Meyer, Ratingen, Germany

[73] Assignee: F. Kurt Retsch GmbH & Co. KG, Haan, Germany

[21] Appl. No.: 603,330

[22] Filed: Feb. 20, 1996

[30] Foreign Application Priority Data

Feb. 20, 1995 [DE] Germany ..... 295 02 787.8

[51] Int. Cl.[6] ..... B02C 19/00

[52] U.S. Cl. ..... 241/100; 241/275; 241/285.2

[58] Field of Search ..... 241/275, 285.2, 241/299, 100

[56] References Cited

U.S. PATENT DOCUMENTS

| | | | |
|---|---|---|---|
| 3,180,582 | 4/1965 | Danyluke | 241/299 X |
| 3,191,873 | 6/1965 | Schmidt | 241/100 X |
| 3,221,997 | 12/1965 | Smit | 241/100 X |
| 4,699,326 | 10/1987 | Warren | 241/275 |
| 4,844,365 | 7/1989 | Rossouw et al. | 241/275 |
| 5,533,685 | 7/1996 | Heck | 241/275 |

FOREIGN PATENT DOCUMENTS

| | | | |
|---|---|---|---|
| 1546137 | 2/1990 | U.S.S.R. | 241/275 |

OTHER PUBLICATIONS

"Ultra–Zentrifugalmühle Typ ZM 1"; p. 27 (no date given).

*Primary Examiner*—John M. Husar
*Attorney, Agent, or Firm*—Robert W. Becker & Associates

[57] ABSTRACT

A centrifugal mill exchangeable cassette for laboratory use has a base body a drive motor, including a drive shaft, connected to the base body. A housing with cover enclosing the base body and the drive motor is provided. The housing has a milling chamber. The cover has an inlet opening for feeding materials to be milled to the milling chamber. A rotor is connected to the drive shaft of the drive motor. The rotor is positioned in the milling chamber. An exchangeable cassette with an annular receptacle and with a radially inner wall consisting of an annular sieve and connected to the annular receptacle is provided. The exchangeable cassette is positioned in the housing so as to surround the milling chamber and the rotor for catching the material milled by the rotor in the milling chamber. The exchangeable cassette has a detachable lid covering the milling chamber and the rotor.

9 Claims, 2 Drawing Sheets

CENTRIFUGAL MILL WITH EXCHANGEABLE CASSETTE

BACKGROUND OF THE INVENTION

The present invention relates to a centrifugal mill for laboratory use with a rotor as a milling tool coupled to a drive motor. An annular sieve encloses the milling chamber of the rotor and an annular receptacle is arranged at the outer circumference of the annular sieve for receiving the milled material, whereby the milling unit comprised of rotor, annular sieve and milling arrangement is closable with a housing cover that has an inlet opening for feeding the material into the mill.

A centrifugal mill with the aforementioned features is disclosed in the brochure of the firm RETSCH GmbH & Co. KG, Haan, Germany, published under the title "Ultra-Zentrifugalmühle Typ ZM 1" (page 27). The known centrifugal mill comprises a rotor as a milling tool which is surrounded by a cup-shaped housing part and slipped onto an upright drive shaft of the motor. It is fastened to the drive shaft with a screw. The milling chamber in which the rotor rotates is surrounded by an annular sieve which is surrounded by an annular receptacle so that the material that has been milled by the rotor rotating at high rotational speeds is forced by centrifugal forces through the annular sieve into the annular receptacle. The thus formed milling unit is closed by a cover to be connected to the housing.

The known centrifugal mill has the disadvantage that the inner side of the housing cover in the area which covers the rotor, respectively, the milling chamber must be considered part of the milling chamber so that upon opening of the housing cover milled material maybe lost. Accordingly, corresponding imprecisions of the analyses of the milled material cannot be prevented. As a further disadvantage it should be mentioned that the cleaning of the known centrifugal mill is very complicated. After opening the cover, the annular sieve and the annular receptacle must be removed one after another from the housing and since these parts are separate components, these parts must be individually cleaned. Furthermore, during the corresponding manipulation of the parts material may again be lost. Finally, it is difficult and cumbersome to exchange the rotor because the screw for connecting the rotor to the drive shaft must be removed with a tool, respectively, must again be tightened with a tool.

It is therefore an object of the present invention to provide a centrifugal mill of the aforementioned kind the manipulation of which is considerably facilitated.

SUMMARY OF THE INVENTION

The centrifugal mill with exchangeable cassette for laboratory use according to the present invention is primarily characterized by:

A base body;

A drive motor, including a drive shaft, connected to the base body;

A housing with a cover enclosing the base body and the drive motor;

The housing having a milling chamber;

The cover having an inlet opening for feeding a material to be milled into the milling chamber;

A rotor connected to the drive shaft of the drive motor;

The rotor positioned in the milling chamber;

An exchangeable cassette comprising an annular receptacle and a radially inner wall comprised of an annular sieve connected to the annular receptacle;

The exchangeable cassette positioned in the housing so as to surround the milling chamber and the rotor for catching the material milled by the rotor in the milling chamber; and The exchangeable cassette comprising a detachable lid covering the milling chamber and the rotor.

Preferably, the annular sieve is connected by interlocking to the annular receptacle.

Advantageously, the exchangeable cassette comprises a bottom plate opposite the lid.

Preferably, the bottom plate has an opening for receiving the drive shaft.

In another embodiment of the present invention, the rotor has a rotor shaft connected to the drive shaft of the drive motor, wherein the bottom plate has an opening for receiving the rotor shaft.

In preferred embodiment of the present invention, the bottom plate is labyrinth plate with a labyrinth seal and the rotor is seated on the labyrinth plate.

Advantageously, the rotor has a sleeve projection detachably connected to the drive shaft of the drive motor so as to be rotationally fixed. The sleeve projection has an inner surface with a groove and the drive shaft of the drive motor has radially displaceable locking elements engaging the groove.

Advantageously, the locking elements of the drive shaft are balls that are radially displaced when a centrifugal force acts on the drive shaft.

In yet another embodiment of the present invention, the drive shaft has an outer mantle surface and the balls are biased by a spring into a locking position in which the balls project radially past the outer mantle surface.

The invention is based on the principle that the annular receptacle is connected to the annular sieve positioned at its inner circumference and is in the form of an exchangeable cassette that can be placed atop the rotor and which further comprises a detachable lid for covering the milling chamber and the rotor. The invention has the advantage that the exchangeable cassette first of all can be removed from the rotor without opening the milling chamber from the rotor so that for a subsequent milling step another exchangeable cassette can be positioned in the housing and the centrifugal mill can be immediately operated. The exchangeable cassette with the milled material can be opened at a suitable location by lifting off the lid and the entire contents can be removed. This facilitates manipulation and also cleaning of the exchangeable cassette which is a unitary part.

The cleaning of the exchangeable cassette is furthermore facilitated when, according to another embodiment of the invention, the annular receptacle and the annular sieve are connected to one another by interlocking and can thus be detached from one another in a simple manner.

According to another embodiment of the invention, it is suggested that the exchangeable cassette be provided with a bottom plate opposite the lid which bottom plate encloses the milling chamber. The bottom plate has an opening for receiving the motor drive shaft, respectively, the rotor shaft. In this embodiment the exchangeable cassette is removed together with the rotor from the motor drive shaft whereby this results in the advantage that the milling chamber is completely closed. After opening the lid, the rotor can be removed from the cassette.

In order to avoid the otherwise required sealing of the rotor shaft relative to the opening at the bottom plate, according of another embodiment of the invention a labyrinth plate may be provided at the bottom of the milling chamber which is generally known from centrifugal mills.

The rotor with a labyrinth design is placed onto the labyrinth plate which comprises a labyrinth seal. The bottom plate in the form of a labyrinth plate is thus part of the exchangeable cassette. As mentioned before, it is known in centrifugal mills to connect the rotor with a sleeve-shaped rotor shaft to the drive shaft of the drive motor and to fixedly connected it thereto. For simplifying this arrangement, respectively, the exchange of the rotor and to thereby provide an improved manipulation of the device, according to another embodiment of the invention the sleeve-shaped projection of the rotor is provided at its inner surface with a groove for receiving locking elements positioned at the motor drive shaft radially displaceable relative to the drive shaft. The locking elements provided at the drive shaft are preferably in the form of balls that are radially displaceable when centrifugal forces act on them. Expediently, according to one embodiment of the invention, the balls are biased by a spring into a position in which they project from the cross-sectional contour of the drive shaft so as to be prestressed into a locking position.

BRIEF DESCRIPTION OF THE DRAWINGS

The object and advantages of the present invention will appear more clearly from the following specification in conjunction with accompanying drawings, in which.

DESCRIPTION OF PREFERRED EMBODIMENT

The present invention will now be described in detail with the aid of a specific embodiment utilizing FIGS. 1 through 3.

Figure 1:
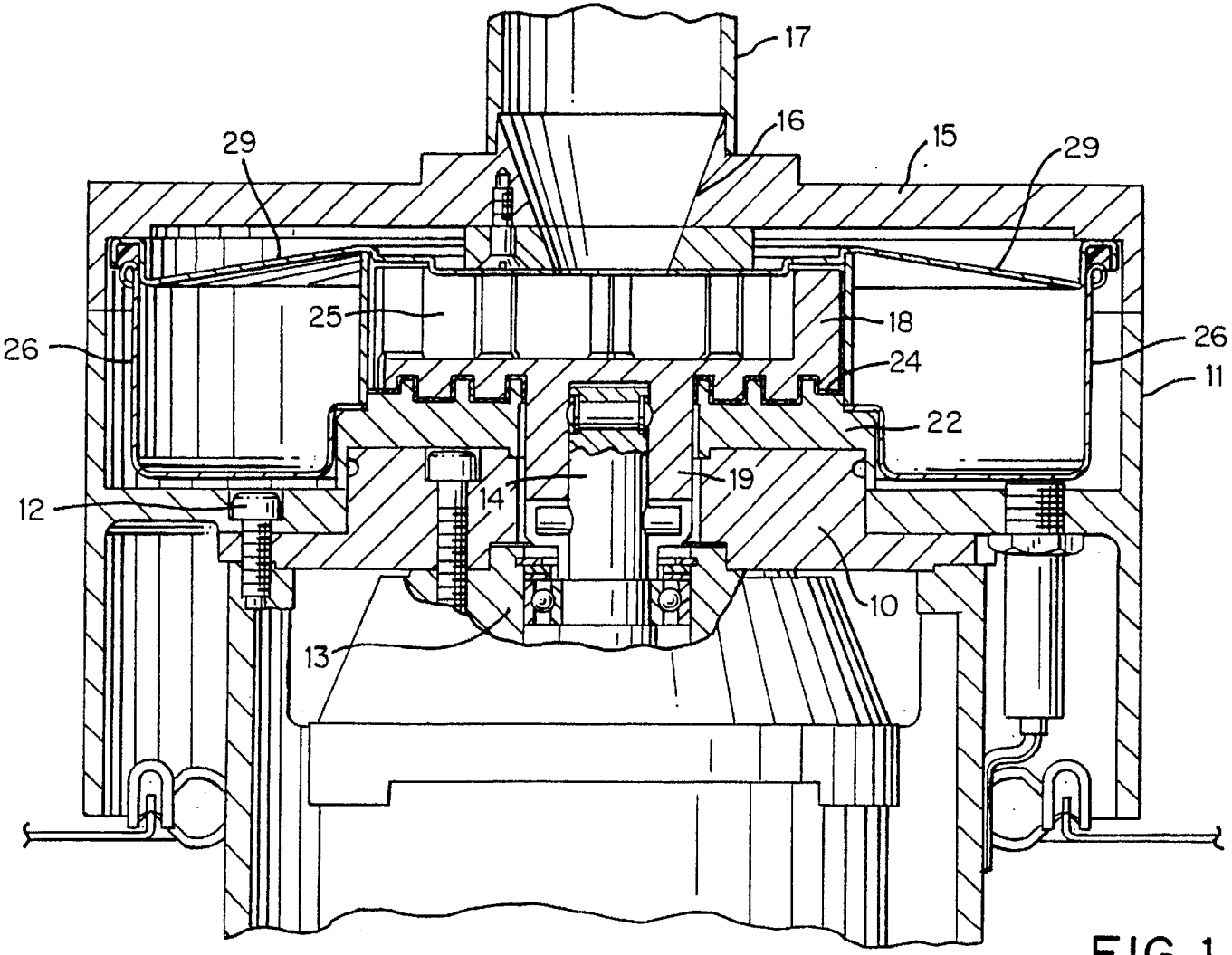
FIG. 1 shows the operational part of a centrifugal mill in cross-section.

The centrifugal mill represented in FIG. 1 in its basic construction comprises a base body 10 to which is connected a cup-shaped upper part 11 as a housing. The connection is achieved with screws 12. A motor 13 is positioned at the base body 10 which has an upright motor drive shaft 14 that projects Upwardly past the base body 10 and extends into the housing 11. The upper housing part 11 closed off is by a housing cover 15 which fits over the upper housing part 11. The cover 15 comprises a funnel 16 as a material inlet opening 17.

Figure 2:
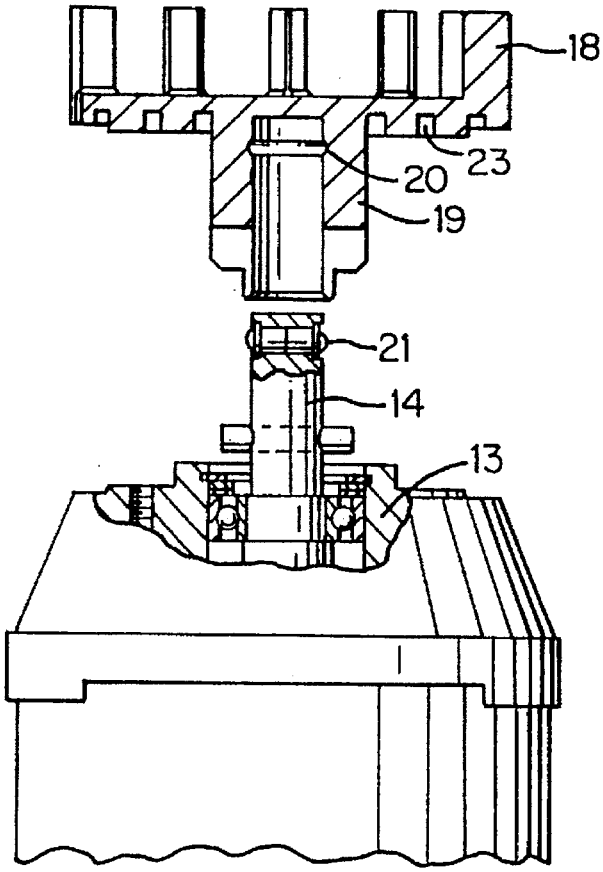
FIG. 2 shows a rotationally fixed connection of the drive shaft and the rotor.

A rotor 18 is placed onto the drive shaft 14 with a sleeve projection 19 whereby the connection of the rotor 18 and the drive shaft 14 can be seen in detail in FIG. 2. For guiding the rotor 18, a labyrinth plate 22 is positioned between the base body 10 and the rotor 18. It is provided with labyrinth projections onto which the rotor 18 is placed in a mating arrangement with a matching labyrinth design 23. A labyrinth seal 24 is provided between labyrinth plate 22 and labyrinth design 23 of the rotor 18 in order to seal the milling chamber 25, defined by the rotor 18, relative to the drive shaft 14.

As can be seen in FIG. 2, the sleeve projection 19 of the rotor 18 is provided at its inner side with a groove 20 which is engaged by balls 21 of the drive shaft 14 which are radially displaceable and biased by a spring in the radially outward direction. Due to the high rotational speeds of the drive shaft 14, respectively, of the sleeve projection 19 of the rotor 18, the balls 21 are forced by centrifugal force outwardly into the groove 20 of the sleeve projection 19 of the rotor 18 and thus provide for a secure locking of the rotor 18. On the other hand, upon standstill, the rotor 18 can be easily removed from the motor drive shaft 14 since upon correspondingly pulling the rotor 18 in the upward direction, the balls 21 are forced into the cross-section of the drive shaft 14 so that the sleeve projection19 can be easily pulled off the motor drive shaft 14.

Figure 3:
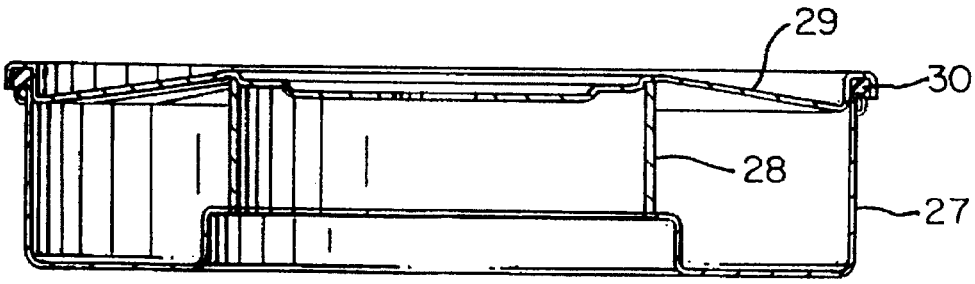
FIG. 3 shows an exchangeable cassette in an individual representation.

As can be seen in FIGS. 1 and 3, the upper housing part 11 can receive an exchangeable cassette 26 which is comprised of an outer annular receptacle 27 and an inner annular sieve 28 positioned at the inner periphery of the receptacle 27. The annular sieve 28 surround the rotor 18, respectively, the milling chamber 25 when the exchangeable cassette 26 is properly mounted in the housing. Receptacle 27 and annular sieve 28 are connected such with one another, preferably by an interlocking connection which is detachable for cleaning purposes, that the exchangeable cassette 26 can be handled as a unit. The exchangeable cassette 26 is provided with its own upper lid 29 which is sealed with a circumferential seal 30 relative to the edge of the receptacle 27 and which can be attached to the receptacle 27 such that it encloses the receptacle 27 and covers the milling chamber 25.

When using the centrifugal mill, the exchangeable cassette 26 is inserted into the upper housing part 11 and the cover 15 is closed. The cover 15 is pressed against the cover 29 of the exchangeable cassette 26 so that the lid 29 is fixedly secured. Via the inlet opening 17 (the funnel 16) the material to be milled is introduced into the milling chamber 25 and is milled, respectively, comminuted by the rotor 18 which rotates at high velocities and is connected via the ball locking elements 21 to the drive shaft 14. The material that has been milled to the desired degree exits via the annular sieve 28 into the receptacle 27. After completion of the milling process, the cover 15 is opened and the exchangeable cassette 26, closed by the lid 29, can be removed from the upper housing part 11 and opened, emptied, and cleaned at another suitable location. When it is desired to also exchange the rotor 18, it possible to pull the rotor 18, due to the aforementioned ball locking elements 21, from the drive shaft 14.

The present invention is, of course, in no way restricted to the specific disclosure of the specification and drawings, but also encompasses any modifications within the scope of the appended claims.

What I claim is:

1. A centrifugal mill with exchangeable cassette for laboratory use, said mill comprising:

a base body;

a drive motor, including a drive shaft, connected to said base body;

a housing with a cover enclosing said base body and said drive motor;

said housing having a milling chamber;

said cover having an inlet opening for feeding a material to be milled into said milling chamber;

a rotor connected to said drive shaft of said drive motor;

said rotor positioned in said milling chamber;

an exchangeable cassette comprising an annular receptacle and a radially inner wall comprised of an annular sieve connected to said annular receptacle;

said exchangeable cassette positioned in said housing so as to surround said milling chamber and said rotor for catching the material milled by said rotor in said milling chamber; and said exchangeable cassette comprising a detachable lid covering said milling chamber and said rotor.

2. A centrifugal mill according to claim 1, wherein said annular sieve is connected by interlocking to said annular receptacle.

3. A centrifugal mill according to claim 1, wherein said exchangeable cassette comprises a bottom plate opposite said lid.

4. A centrifugal mill according to claim 3, wherein said bottom plate has an opening for receiving said drive shaft.

5. A centrifugal mill according to claim 3, wherein said rotor 18 has a rotor shaft connected to said drive shaft of said drive motor, and wherein said bottom plate has an opening for receiving said rotor shaft.

6. A centrifugal mill according to claim 3, wherein said bottom plate is a labyrinth plate with a labyrinth seal and wherein said rotor is seated on said labyrinth plate.

7. A centrifugal mill according to claim 1, wherein said rotor has a sleeve projection detachably connected to said drive shaft of said drive motor so as to be rotationally fixed, wherein said sleeve projection has an inner surface with a groove and wherein said drive shaft of said drive motor has radially displaceable looking elements engaging said groove.

8. A centrifugal mill according to claim 7, wherein said looking elements of said drive shaft are balls that are radially displaced when a centrifugal force acts on said drive shaft.

9. A centrifugal mill according to claim 8, wherein said drive shaft has an outer mantle surface and wherein said balls are biased by a spring into a looking position in which said balls project radially past said outer mantle surface.

* * * * *